US009163420B2

(12) United States Patent
Behague et al.

(10) Patent No.: US 9,163,420 B2
(45) Date of Patent: Oct. 20, 2015

(54) AUDITORIUM SEATING

(71) Applicant: STI Serapid Group, Rouxmesnil-Bouteilles (FR)

(72) Inventors: Julien Behague, Vassonville (FR); Mickaël Mauger, Belleville sur Mer (FR)

(73) Assignee: STI Serapid Group, Rouxmesnil-Bouteilles (FR)

( * ) Notice: Subject to any disclaimer, the term of this patent is extended or adjusted under 35 U.S.C. 154(b) by 0 days.

(21) Appl. No.: 14/196,069

(22) Filed: Mar. 4, 2014

(65) Prior Publication Data

US 2015/0068132 A1 Mar. 12, 2015

(30) Foreign Application Priority Data

Mar. 4, 2013 (FR) ..... 1 351887

(51) Int. Cl.

| | |
|---|---|
| ***E04H 3/30*** | (2006.01) |
| ***A47C 1/126*** | (2006.01) |
| ***E04H 3/12*** | (2006.01) |
| ***A47C 1/121*** | (2006.01) |
| ***E04H 3/14*** | (2006.01) |

(52) U.S. Cl.

CPC *E04H 3/30* (2013.01); *A47C 1/121* (2013.01); *A47C 1/126* (2013.01); *E04H 3/12* (2013.01); *E04H 3/126* (2013.01); *E04H 3/14* (2013.01); *E04H 2003/145* (2013.01)

(58) Field of Classification Search

CPC ..... E04H 3/123; E04H 3/126; E04H 3/12; E04H 3/14

USPC ..... 52/9, 10

See application file for complete search history.

(56) References Cited

U.S. PATENT DOCUMENTS

| | | | | |
|---|---|---|---|---|
| 1,517,774 | A * | 12/1924 | Duprey | 52/10 |
| 4,569,162 | A * | 2/1986 | Suzuki | 52/9 |
| 5,517,789 | A * | 5/1996 | Sugiyama | 52/10 |
| 7,172,245 | B2 * | 2/2007 | Bouchard et al. | 297/217.7 |
| 8,490,335 | B2 * | 7/2013 | LaForest | 52/8 |
| 2008/0190038 | A1 * | 8/2008 | Jacobs et al. | 52/9 |
| 2009/0211169 | A1 * | 8/2009 | Ham | 52/10 |

FOREIGN PATENT DOCUMENTS

| | | |
|---|---|---|
| FR | 2746435 A1 | 9/1997 |
| WO | WO0207566 A1 | 1/2002 |

OTHER PUBLICATIONS

European Search Report/Search Opinion dated Jun. 14, 2013 in corresponding EP Appl. No. 14157621.5.

* cited by examiner

*Primary Examiner* — Brian Glessner
*Assistant Examiner* — Adam Barlow
(74) *Attorney, Agent, or Firm* — Drinker Biddle & Reath LLP

(57) ABSTRACT

A multipurpose hall equipped with a set of beams supporting seats (1) bearing independent load-bearing units (3) equipped with a group of seats (4) which can be arranged in a stepped configuration or a flat configuration, characterized in that it comprises means for tilting the groups of seats (4) which for each of the load-bearing units (3) comprises at least one pantograph mechanism (9) comprising a fixed support (10) of one piece with the load-bearing beam (1) and a movable support (11) of one piece with the load-bearing unit (3) and the group of seats, as well as a control linkage whereby the group of seats (4) can be moved between a deployed position and a retracted position by rotation around the fixed support (10).

8 Claims, 3 Drawing Sheets

AUDITORIUM SEATING

This invention relates to a hall, in particular a multipurpose auditorium which as a general rule is bounded by essentially vertical walls and is equipped with a set of seats subdivided into several parallel rows.

In each of these rows the seats are conventionally subdivided into several groups of seats placed side by side, separated by gangways.

Halls may be used to enable the public to attend various entertainments such as plays, concerts, lectures, etc., in which case they have to be arranged in a stepped configuration in which the seats in the different rows are above and offset in relation to the others, but also other functions such as sales, banquets, dances, etc., in which case the halls have to have a perfectly flat rigid floor.

It is therefore desirable to have systems which allow a hall arranged in one stepped configuration to be easily, quickly and safely converted into a hall arranged in a configuration allowing it to have a flat floor or a planar configuration.

With this object it has already been suggested that halls, in particular multipurpose auditoria, should be equipped with a set of movable beams supporting seats which in general have an essentially rectangular cross-section arranged parallel one behind the other and are fitted with lining panels forming the floor of the room in the planar configuration.

It should be noted that in the context of this description the terms front, back, top, bottom, etc., relate to a hall arranged in a stepped configuration.

More specifically, each of these beams generally carries a number of independent load-bearing units, each comprising a group of seats mounted side by side on a common movable base equipped with lifting means enabling them to be moved vertically.

As for the load-bearing units, these are each equipped with tilting means, enabling them to move the groups of seats between the deployed position above the lining panels of the load-bearing beams and another position in which they are retracted beneath these panels.

It should be noted that the beams can, of course, only carry one load-bearing unit without thereby going beyond the scope of the invention.

Combined activation of the means for lifting the load-bearing beams and the means for tilting the load-bearing units makes it possible for a hall to be arranged in either the stepped configuration in which the groups of seats are deployed above the lining panels, and the load-bearing beams are stepped and set back from one another, or the planar configuration in which the lining panels are arranged immediately adjacent to each other in the same plane in such a way as to form a rigid floor.

In such a system the means for lifting the load-bearing beams conventionally comprise vertical lateral rails which, for example, provide guidance for rollers acting together with the drive means, or, if it is impossible to fit guide rails because of space reasons, units of the scissor type, which are well known, in particular in the field of theatres.

Such known lifting means have, on the whole, proved themselves to be satisfactory.

However it is currently suggested that these lifting means should be associated with means for tilting the load-bearing units which, in general, make it possible to bring about a 180° rotation of the groups of seats, which are not wholly satisfactory and give rise to a number of disadvantages.

The first of these disadvantages is associated with the fact that given the standard ratio between the height of the seats and the width of the rows, these seats can no longer pass between the latter as they rotate between the deployed position and the retracted position when the load-bearing beams are located at essentially the same height.

Subsequently, in order to change the arrangement of a hall between the stepped configuration and the flat configuration, it is necessary to lower some load-bearing beams and remove others, which gives rise to problems with synchronisation of the movements for lifting the load-bearing beams and tilting the load-bearing units.

Now these problems appreciably increase the time and cost of changing the arrangement of the hall.

The second of the above-mentioned disadvantages is associated with the fact that the known means for tilting load-bearing units cannot be adjusted to all beam shapes, particularly bowed shapes, so that the load-bearing beams have to be straight in order to allow the groups of seats to rotate.

As a result, where the geometry of the hall makes it impossible to fit straight beams the beams must be subdivided into several straight sections arranged side by side and angularly offset, which complicates the system and is furthermore unsatisfactory from the aesthetic point of view.

A third disadvantage of the known means for tilting the load-bearing units is associated with the fact that these means cannot be fitted to the back row of seats, given that this row is located in the immediate vicinity of a vertical wall; as a consequence, in order that the location of this last row is not lost, the only possibilities comprise making recesses in the rear wall, so as to make it retractable, or again to manually dismantle the seats in this last row and take them somewhere else, which is particularly time-consuming and costly in labour.

The object of this invention is to overcome these disadvantages by providing a hall, in particular a multipurpose auditorium of the above-mentioned type, in which the load-bearing beams are equipped with conventional lifting means while the independent load-bearing units are provided with means for tilting groups of seats which are compatible with these conventional lifting means, but designed in such a way that the hall can easily, quickly and wholly safely be changed from a flat configuration to a stepped configuration or vice versa without the need for particular synchronisation between the different movements, and which is furthermore such as to make it possible to benefit from all the surface area available and to fit all types of beams, whether straight or bowed.

It should be noted that in the context of this description the terms "stepped configuration" and "flat configuration" must be understood in a very broad and non-restrictive sense.

Specifically, in accordance with the invention, all possible configurations of the hall may be envisaged, including by way of example a floor without seats but comprising several steps, each defined by a number of adjacent beams located at the same level ("cabaret" type configuration) or a floor in which only one row out of two is fitted with seats (configuration of the "lecture" type) or again a flat floor fitted with seats, etc.

In accordance with invention, the means for tilting the groups of seats comprise at least one pantograph mechanism comprising a fixed support of one piece with the load-bearing beam and a movable support of one piece with the load-bearing unit in each of the independent load-bearing units, and the group of seats, together with control linkages through which the group of seats can be moved between a deployed position and a retracted position by rotation about the fixed support.

According to a preferred characteristic of the invention the control linkage comprises two parallel working arms linking the fixed support and the movable support, articulated on these supports around articulation pivots at their respective extremities in such a way as to form a deformable parallelogram.

At least one of these articulation pivots or articulation drive pivots, which may be mounted on the fixed support or on the movable support, is driven by control means, in particular by a geared electric motor, while the other articulation pivots are inert assembly pivots.

Rotation of the articulation drive pivot causes the working arm on which it is mounted to rotate around the fixed support, either directly or as a result of the force of the applied torque, while the other arm can transmit this rotation to the load-bearing unit and the group of seats.

It should be noted that, depending upon its length and its weight, each of the load-bearing units may only be fitted with one pantograph mechanism, but as a general rule they will be fitted with two pantograph mechanisms respectively, located at each of their extremities, or even furthermore one or more auxiliary median pantograph mechanisms.

In accordance with the invention the group of seats rests on the lining panel in the deployed position but must be raised a little from that panel when it starts to tilt towards the retracted position, or at the end of its tilting to the deployed position.

In order that this tilting can take place in a satisfactory way, reducing the space used in the course of this as much as possible, it is essential that the geometry of the pantograph mechanism be adjusted and optimised, in particular the inclination and length of the fixed support and the length and spacing of the working arms.

Independently of the above, it should be noted that the tilting movement of the load-bearing units and the groups of seats between the deployed position and the retracted position includes a singularity at which the four articulation pivots are in line.

Now in such a situation the control means may cause the pantograph mechanism to rotate in one direction or the other, and it is therefore necessary to provide this mechanism with compensating means whereby this difficulty can be overcome.

In accordance with the invention, these compensating means may advantageously comprise a synchronisation arm connecting the operating arms in their median parts and articulated on these arms at their respective extremities around synchronisation pivots offset in relation to the articulation pivots.

Other compensating means may however also be provided without thereby going beyond the scope of the invention, such as for example second control means, in particular a second geared electric motor, or again means linking the pivots, providing each of the supports with chain and pinion or pulley and belt systems, for example.

In accordance with the invention, tilting of the load-bearing units and the groups of seats generally takes place to the back of the load-bearing beams, but sometimes such backwards tilting is impossible, in particular as a result of the lack of space caused by the proximity of a wall.

The invention also makes it possible to overcome this difficulty and to use all the space available for installing rows of seats.

For this purpose, and according to another characteristic of the invention, the means for tilting the load-bearing units act together with inversion means, which make it possible to combine the tilting of groups of seats around the fixed support of the pantograph mechanism with lateral motion of these groups of seats along the lining panels in such a way that this tilting takes place not to the back of the load-bearing beams but to the front.

In accordance with the invention these inverting means advantageously comprise a plate fitted with a slider fixed to the underside of the lining panel and a blade fixed to the base supporting the group of seats and penetrating that slider, passing through a slot pierced in the lining panel at right angles to it, in order to allow lateral movement of this base and the group of seats along the top surface of the panel.

The slot pierced in this way may be closed up after the lateral movement, for example by a system of manual or motor-driven shutters.

The characteristics of a hall, in particular the multipurpose auditorium which is the subject matter of the invention, will be described in greater deal with reference to the appended non-restricted drawings, in which:

FIG. 1 is a perspective view of a load-bearing beam;

FIGS. 2*a* and 2*b* are diagrammatical perspective views illustrating a first variant of the lifting means and showing the load-bearing beam in FIG. 1 in the bottom and top positions respectively;

FIGS. 3*a* and 3*b* are perspective views similar to FIGS. 2*a* and 2*b*, but illustrate a second variant of the lifting means;

Figure 6A:
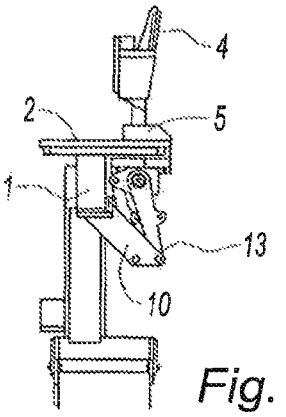
Figure 6B:
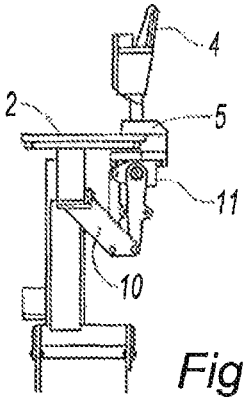
Figure 6C:
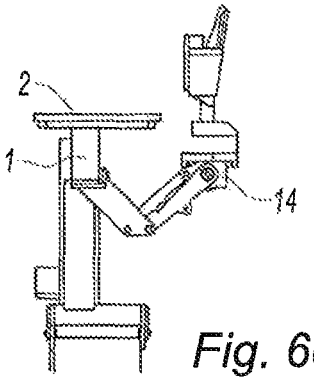
Figure 6D:
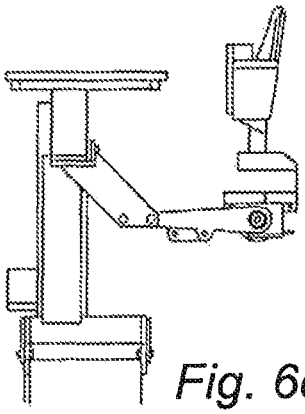
Figure 6E:
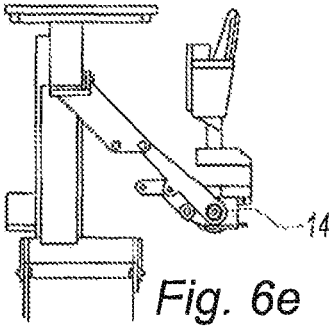
Figure 6F:
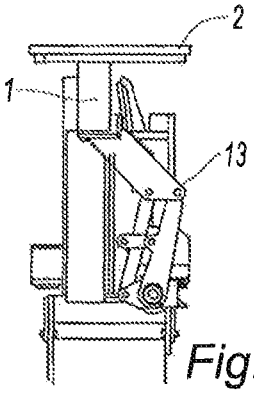

FIGS. 6*a* to 6*f* are diagrams illustrating the backward tilting movement of a seat between the deployed position illustrated in FIG. 6*a* and the retracted position illustrated in FIG. 6*f;*

Figure 7:
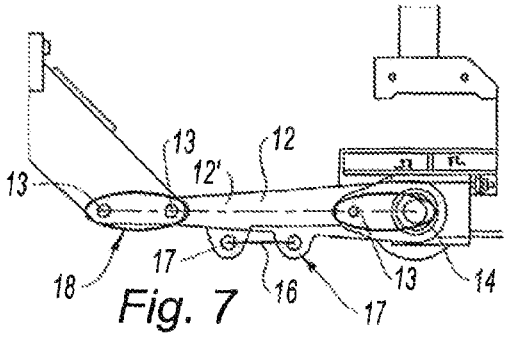
Figure 9:
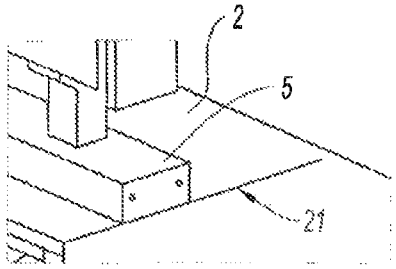

FIG. 7 is a diagram illustrating the singularity point;

FIGS. 8*a*, 8*b*, 8*c* and 8*d* are diagrams corresponding to FIGS. 6*a* to 6*f* illustrating the variant embodiment of the invention in which tilting of the seats takes place forwards;

FIG. 9 is a perspective view showing the detail of the inversion means.

Figure 1:
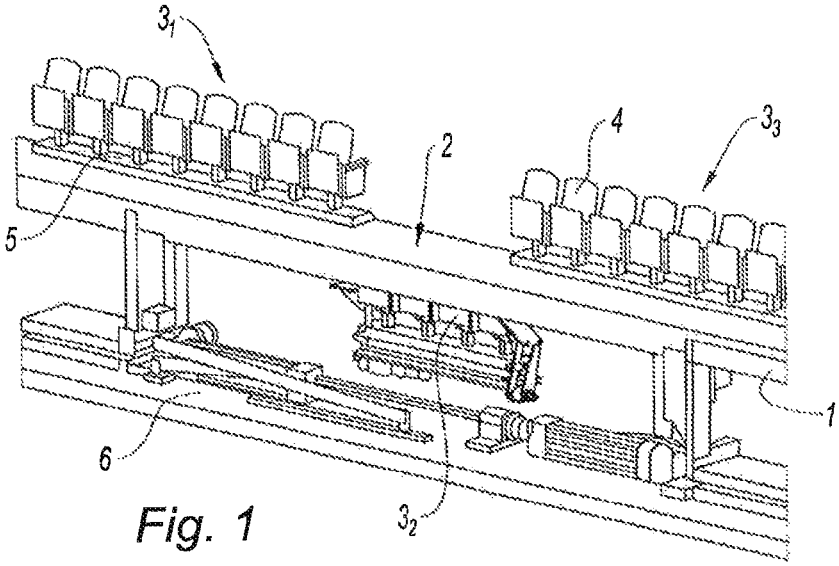

As shown in FIG. 1, the auditorium is equipped with a set of parallel horizontal load-bearing beams 1, of which only one is illustrated; these load-bearing beams 1 have a rectangular cross-section and are lined with panels 2 which form the floor of the hall in the flat position.

Load-bearing beam 1 carries a number of independent load-bearing units 3, each comprising a set of seats 4, mounted side by side on a common movable base 5.

In the embodiment illustrated in FIG. 1 load-bearing 1 carries three independent load-bearing units $\mathbf{3}_1$, $\mathbf{3}_2$ and $\mathbf{3}_3$.

Tilting means whose configuration will be described in detail below in this description, make it possible to move the load-bearing units and groups of seats 4 between a deployed position above lining panel 2 of load-bearing beam 1 and a position in which they are retracted beneath panel 2.

In the embodiment illustrated in FIG. 1 load-bearing units $\mathbf{3}_1$ and $\mathbf{3}_3$ are shown in the deployed position, whereas load-bearing unit $\mathbf{3}_2$ is shown in the retracted position.

Figure 2B:
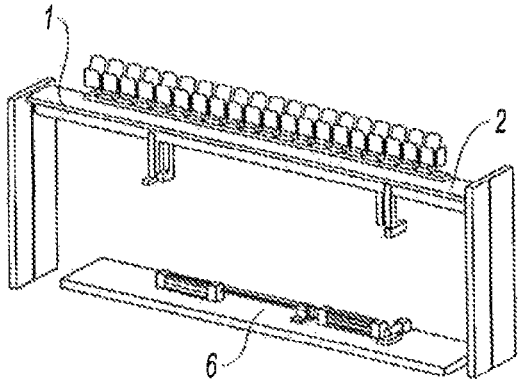
Figure 2A:
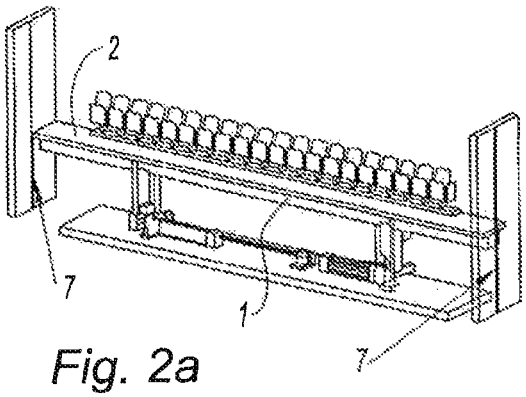
Figure 3B:
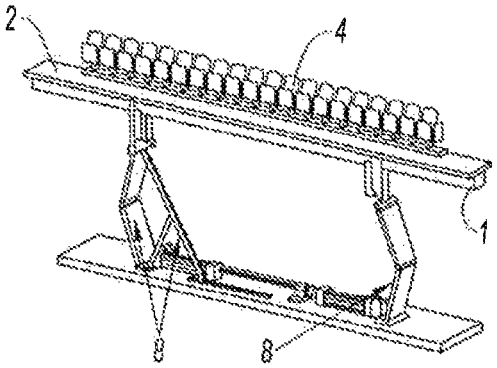
Figure 3A:
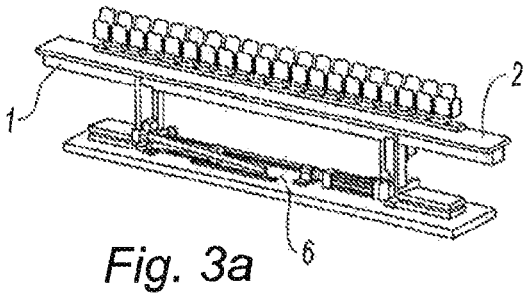

As shown in FIGS. 2*a*, 2*b*, 3*a* and 3*b*, lifting means make it possible to move load-bearing beam 1 between a bottom position shown in FIGS. 2*a* and 3*a*, in which it bears on a base 6, and a top position shown in FIGS. 2*b* and 3*b*.

In accordance with the embodiment illustrated in FIGS. 2*a* and 2*b*, the means for lifting load-bearing beam 1 comprise two lateral vertical rails 7 used to guide the rollers, not shown, mounted at the respective extremities of this beam 1, which act together with drive means.

As shown in FIGS. 3*a* and 3*b*, the guide means comprise motor-driven units of the scissor type 8 attached to the bottom part of load-bearing beam 1.

The combined activation of lifting means 7, 8, for load-bearing beams 1 and the tilting means for load-bearing units 3 and groups of seats 4, which will be described in greater detail below in this description, make it possible to arrange the hall either in a stepped configuration or a flat configuration in which the lining panels 2 of respective load-bearing beams 1 are arranged immediately adjacent to each other in the same plane.

Figure 4:
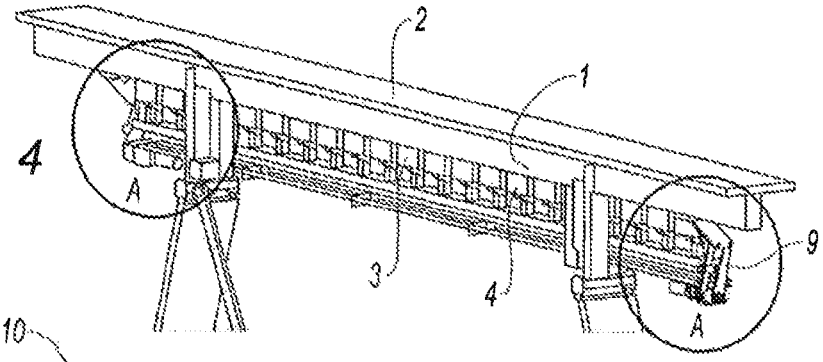
FIG. 4 is a perspective view of a load-bearing beam bearing a load-bearing unit fitted with a group of seats, illustrated in the retracted position, and tilting means at each of its extremities.

As shown in FIG. 4, load-bearing unit 3 has tilting means 9 for the group of seats 4 at each of its extremities.

Figure 5:
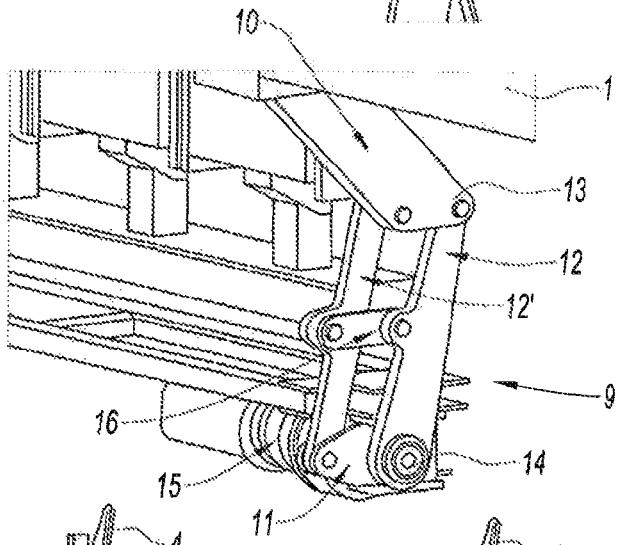
FIG. 5 shows the detail "A" in FIG. 4.

As shown in FIG. 5, these tilting means 9 each comprise a pantograph mechanism, comprising a fixed inclined support 10 of one piece with load-bearing beam 1 (also shown in FIGS. 6*a* to 6*f*) and a movable support 11 of one piece with load-bearing unit 3, and therefore base 5 supporting group of seats 4.

Fixed support 10 and movable support 11 are connected by two parallel working arms 12, 12' articulated on these supports 10, 11 around four articulation pivots 13, 14 at their respective extremities in such a way as to form a deformable parallelogram.

One of articulation pivots 14 mounted on movable support 11 is the drive pivot which is driven in rotation by a geared motor 15, while the other three articulation pivots 13 are inert assembly pivots.

The rotation of articulation drive pivot 14 causes working arm 12 to one extremity of which it is connected to rotate around articulation pivot 13 mounted at the other extremity of this arm 12 on fixed support 10 as a result of the force of the torque so applied.

This rotation is transmitted to load-bearing unit 3 and group of seats 4 by the other working arm 12' in such a way as to tilt this group of seats 4 behind load-bearing beam 1 between the deployed position above lining panel 2, shown in FIG. 6*a*, and the retracted position below that panel, shown in FIG. 6*f*, passing through the intermediate positions illustrated in FIGS. 6*b* to 6*e*, in particular the position shown in FIG. 6*b* in which base 5 supporting group of seats 4 is raised a little from lining panel 2.

It should be noted that the geometry of pantograph mechanism 9 is selected in such a way as to limit as far as possible the space taken up by group of seats 4 during this tilting motion.

As shown in FIG. 7, as group of seats 4 tilts between the deployed position shown in FIG. 6*a* and the retracted position shown in FIG. 6*f* there is a singularity point at which the three mounting pivots 13 and drive pivot 14 are in line.

In this position drive pivot 14 may cause articulation arm 12 on which it is mounted to continue rotation in one direction or the other, so pantograph mechanism 9 has to be fitted with compensating means so that this singularity can be overcome.

As shown in FIGS. 5 and 7 these compensating means comprise a synchronisation arm 16 linking working arms 12, 12' in their median parts and articulated on these arms at their respective extremities around synchronisation pivots 17, which are offset with respect to articulation pivots 13, 14 of working arms 12, 12'.

Another possibility also illustrated in FIG. 7 comprises connecting the two pivots 13, 14 respectively mounted on fixed support 10 and on movable support 11 by means of chains or belts 18.

As shown in FIGS. 8*a* to 8*d*, steric hindrance brought about by the proximity of a vertical wall 19 makes it impossible for the back row of seats 4 to tilt backwards between the deployed position and the retracted position illustrated in FIGS. 6*a* to 6*f*.

In this case tilting takes place not behind load-bearing beam 1, but in front, and pantograph mechanism 9' has a similar configuration to that of pantograph mechanism 9 shown in FIG. 5, but inverted.

Furthermore the inversion means make it possible to combine the tilting of load-bearing units 3 and groups of seats 4 between the deployed position and the retracted position with lateral movement of these units along lining panel 2, as illustrated by arrows I and II.

As shown in FIGS. 8*a* to 8*d* and 9, these inversion means comprise an additional plate 20 fitted with a guide slider, not shown, fixed on the underside of lining panel 2 and a blade 22 attached to base 5 bearing group of seats 4.

Figure 8A:
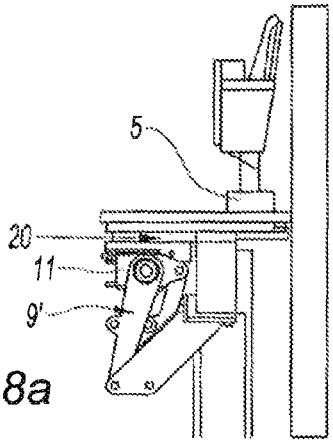
Figure 8B:
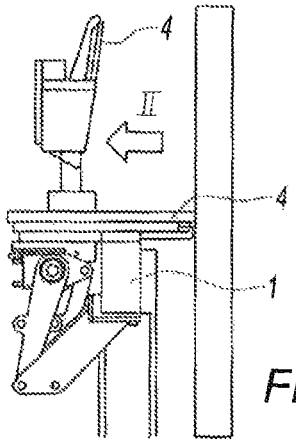
Figure 8C:
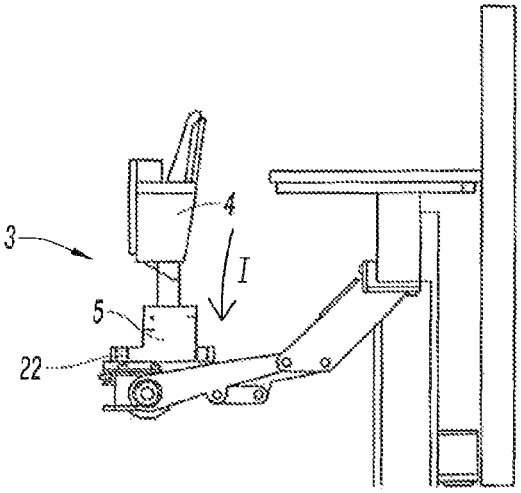
Figure 8D:
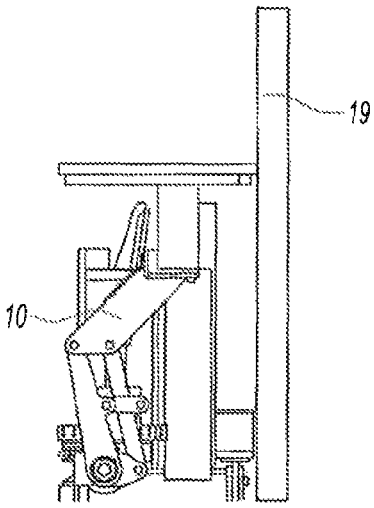

This blade 22 penetrates the guide slider passing through a slot 21 made in lining panel 2 at right angles to the slider in such a way as to allow base 5 and group of seats 4 to move laterally, as shown in FIGS. 8*a* and 8*b*, and then for this assembly to tilt between the deployed position and the retracted position as shown in FIGS. 8*c* and 8*d*.

KEY

1. Load-bearing beam
2. Lining panels
3. Load-bearing units
4. Groups of seats
5. Movable base
6. Fixed base
7. Lifting means
8. Lifting means
9, 9'. Pantograph mechanism
10. Fixed support
11. Movable support
12, 12'. Operating arm
13. Internal articulation pivots
14. Articulation drive pivot
15. Geared motor
16. Synchronisation arm
17. Synchronisation pivots
18. Chains or belts
19. Vertical wall
20. Slide plate
21. Slot
22. Blade

The invention claimed is:

1. A hall equipped with a set of parallel horizontal beams respectively covered with lining panels, the beams supporting seats, each of these beams having independent load-bearing units respectively comprising a group of the seats mounted side by side on a common base and being fitted with lifting mechanisms by which they may be moved vertically, each of these load-bearing units being equipped with a tilting mechanism whereby the groups of seats are moved between a deployed position above the lining panels of the load-bearing beams and a retracted position below the panels, in such a way that the hall can be arranged in a stepped configuration or a flat configuration in which the lining panels of the load-bearing beams are located in the immediate vicinity of each other in the same plane, wherein the tilting mechanisms for the groups of seats comprise for each of the independent load-bearing units at least one pantograph mechanism comprising a fixed support of one piece with the load-bearing beam and a movable support of one piece with the load-bearing unit and the group of seats together with a control linkage whereby the group of seats is moved between the deployed position and the retracted position by rotation about the fixed support; and wherein the control linkage comprises two parallel working arms linking the fixed support and the movable support and articulated on the supports around articulation pivots at their respective extremities in such a way as to form a deformable parallelogram.

2. A hall according to claim 1, wherein at least one of the articulation pivots being driven by a control mechanism in such a way that the group of seats can be moved between the deployed position and the retracted position by rotation about the fixed support, while the other articulation pivots are inert assembly pivots.

3. A hall according to claim 2, wherein the tilting mechanisms for the groups of seats comprise compensating mechanisms whereby the singularity at which the four articulation pivots are in line in the course of tilting between the deployed position and the retracted position is overcome.

4. A hall according to claim 3, wherein the compensating mechanisms comprise a synchronisation arm connecting the operating arms at their median part and articulated on these arms at their respective extremities around synchronisation pivots which are offset in relation to the articulation pivots for the working arms.

5. A hall according to any one of claims 1 to 4, wherein if there is steric hindrance caused by the proximity of a wall, the tilting mechanisms of the groups of seats act together with inversion mechanisms, which make it possible to combine the tilting of these groups of seats around the fixed support with lateral movements of these groups of seats along the lining panels.

6. A hall according to claim 5, characterised in that the inversion mechanisms comprise a plate fitted with a slider fixed on the underside of the lining panel and a blade attached to the base supporting the group of seats and penetrating this slider passing through a slot made in the lining panel at right angles to the lining panel in such a way as to allow the base and the group of seats to move laterally along the upper surface of the lining panel.

7. A hall according to claim 1, which is a multipurpose auditorium bounded by vertical walls.

8. A hall according to claim 3, wherein the control mechanism comprises a geared electric motor.

* * * * *